US009962819B2

(12) United States Patent
Grace, Jr.

(10) Patent No.: US 9,962,819 B2
(45) **Date of Patent: *May 8, 2018**

(54) TORQUE WRENCH FOR ARCHERY BROADHEADS AND FASTENERS

(71) Applicant: Grace Engineering Corp., Memphis, MI (US)

(72) Inventor: Louis Grace, Jr., North Street, MI (US)

(73) Assignee: Grace Engineering Corp., Memphis, MI (US)

( * ) Notice: Subject to any disclaimer, the term of this patent is extended or adjusted under 35 U.S.C. 154(b) by 290 days.

This patent is subject to a terminal disclaimer.

(21) Appl. No.: 14/995,761

(22) Filed: Jan. 14, 2016

(65) Prior Publication Data

US 2016/0136793 A1 May 19, 2016

Related U.S. Application Data

(63) Continuation of application No. 14/171,865, filed on Feb. 4, 2014, now Pat. No. 9,259,825.

(60) Provisional application No. 61/761,508, filed on Feb. 6, 2013.

(51) Int. Cl.

| | |
|---|---|
| ***B25B 13/50*** | (2006.01) |
| ***F41B 5/14*** | (2006.01) |
| ***F42B 6/08*** | (2006.01) |
| ***B25B 23/142*** | (2006.01) |

(52) U.S. Cl.

CPC ..... *B25B 23/1427* (2013.01); *B25B 13/50* (2013.01); *F41B 5/148* (2013.01); *F42B 6/08* (2013.01)

(58) Field of Classification Search

CPC ..... B25B 23/1427; B25B 13/50; F41B 5/148; F42B 6/08

See application file for complete search history.

(56) References Cited

U.S. PATENT DOCUMENTS

| | | | |
|---|---|---|---|
| 3,577,778 | A | 5/1971 | Liepins |
| 4,283,829 | A | 8/1981 | Saunders |
| 5,189,749 | A | 3/1993 | Thomas et al. |
| 5,224,400 | A | 7/1993 | Maleski |
| 6,439,086 | B1 | 8/2002 | Bahr |
| 6,557,441 | B1 | 5/2003 | Brihier |
| 7,159,494 | B2 | 1/2007 | Jamnia et al. |
| 8,136,431 | B2 | 3/2012 | Wengreen |
| 8,276,487 | B2 | 10/2012 | Wengreen et al. |
| 9,169,882 | B2 | 10/2015 | Witte |
| 9,259,825 | B2 * | 2/2016 | Grace, Jr. ..... B25B 23/1427 |
| 2014/0123819 | A1 | 5/2014 | Beemer et al. |

* cited by examiner

*Primary Examiner* — David B Thomas

(74) *Attorney, Agent, or Firm* — Warner Norcross and Judd, LLP

(57) ABSTRACT

A tool for archery broadheads or other fasteners is provided including an engagement end having an aperture, socket or drive feature to accommodate the broadhead or engage a fastener. The tool is constructed at least partially from an elastomeric material. Upon application of a moment to the tool by a user, part of the tool deforms or twists so that indicia elements move relative to one another and output torque or moment information to a user based on the spatial orientation of the indicia elements relative to one another.

20 Claims, 3 Drawing Sheets

TORQUE WRENCH FOR ARCHERY BROADHEADS AND FASTENERS

BACKGROUND OF THE INVENTION

The present invention relates to archery products and fasteners, and more particularly to a tool for installing and tightening a broadhead relative to a projectile, such as an arrow, or for installing a fastener relative to a work piece.

There are a variety of broadheads on the market today. Some broadheads are fixed, replaceable blade broadheads having two, three, or four blades. The blades are replaceable relative to a ferrule of the broadhead. A popular fixed, replaceable three-blade construction is the Stryker™ available from G5 Outdoors LLC. Other broadheads are of a monolithic single-piece structure with a number of permanent blades. A well-established, standard monolithic broadhead in the industry is the Montec™ which is also available from G5 Outdoors LLC. Yet other broadheads are referred to as mechanical broadheads, which include blades that move and/or expand relative to a ferrule. A common mechanical broadhead is the Tekan™ or T3™, also available from G5 Outdoors LLC.

The above broadheads typically are attached to arrows to be shot from conventional archery bows, or bolts to be shot from cross bows. The broadheads include a threaded portion that is joined with a ferrule. The threaded portion mates with a like-threaded insert which is glued, fastened or otherwise secured to an interior or exterior of the arrow or bolt. The inserts typically are made from metal, such as aluminum, or a composite.

Typically, when an archer installs a broadhead on an arrow, the archer threads the threaded portion of the broadhead into corresponding threads in the insert. If the archer does not have an appropriate tool to grasp the broadhead and/or ferrule, frequently the broadhead is not sufficiently tightened to the insert. Sometimes, even with an appropriate tool, the archer does not sufficiently tighten the broadhead.

Accordingly, several issues can develop. For example, the broadhead can back out or unthread from the insert and/or arrow. This can happen when the arrow is transported in a quiver on an archery bow, or otherwise subjected to vibration which causes the broadhead to unthread. Alternatively, the broadhead can sometimes unthread if not properly tightened or torqued down relative to the insert by the arrow spinning through the air.

The untightening or unthreading of the broadhead from the arrow or bolt can cause further issues. For example, if a broadhead backs out too much, the broadhead can simply fall off the arrow and be lost. In other cases, the broadhead ferrule can back out sufficiently so that one or more of the broadhead blades becomes misaligned with the ferrule, other cutting edges on the broadhead, and/or vanes of the arrow. Alternatively, with a replaceable blade or mechanical broadhead, one or more of the blades can be lost altogether. The unthreading of the broadhead from the arrow further can cause erratic or inconsistent flight, which can affect accuracy and consistency in shooting of the arrow.

While there are some tools on the market which allow tightening of the broadheads, most are very simplistic—typically including a flat handle attached to a flat ring that defines a number of slots corresponding to the number of blades in the broadhead. An archer places the ferrule and blades within the slots of the tool, and turns the broadhead, tightening it down relative the arrow or bolt. While this tool can provide some degree of tightening, the exact torque with which the broadhead is installed relative to the arrow or bolt generally it is unknown. Accordingly, the archer frequently under torques the broadhead, so it is prone to unthreading. Other times, the archer over torques the broadhead, which can strip the insert and make it difficult to remove the broadhead for replacement or sharpening of the blades.

In the realm of fasteners, it is frequently the objective to tighten a threaded fastener relative to a threaded aperture in a work piece to a desired torque. Torque wrenches are sometimes utilized to achieve this objective. Many torque wrenches provide too much information, and can be overly complicated with digital readouts, scales and the like. These added features also make most conventional torque wrenches overly expensive.

SUMMARY OF THE INVENTION

An installation tool for archery broadheads or fasteners is provided including an engagement end having an aperture, socket or drive feature to accommodate the broadhead or engage a fastener. The tool is constructed at least partially from an elastomeric material.

In one embodiment, the engagement end of the tool includes a first portion configured to directly engage the blade and/or ferrule of the broadhead. A second portion of the tool is connected to the first portion. The first portion and second portion can be integral with one another, forming a single piece, monolithic construction. The first and second portions are constructed so that when an excessive rotational force, torque or moment is applied to one or both of the portions, they can move relative to one another.

In another embodiment, the first portion and second portion are joined with an intermediate connector. The intermediate connector can be of a smaller dimension than the first portion and/or the second portion, but still can form a part of the monolithic construction. Optionally, the first and second portions, and the intermediate connector can be independent parts, joined together with fasteners, adhesives or other structures.

In yet another embodiment, the tool is operable in first and second modes. In the first mode, the tool is initially installed on the broadhead without applying substantial torque or a rotational moment to the broadhead. In this mode, indicia elements are misaligned with one another. Optionally, the indicia elements can be fixed in relation to the first portion and the second portion respectively, but not relative to one another, that is, they are movable relative to one another. In the second mode, the archer exerts a moment on the broadhead with the tool. When a predetermined amount of torque is applied to the broadhead to appropriately tighten it relative to an insert, the indicia elements align with one another to indicate to the archer that an appropriate amount of torque has been applied to the broadhead to install it relative to the insert. Thereafter, the archer can discontinue force application and remove the tool from the broadhead.

In still another embodiment, the tool can include the first end and an opposing second end. The first end can be constructed with a socket or other structure to accommodate a broadhead having a three-blade construction, with slots defined by the end offset at approximately 120° relative to one another. The opposing second end can define a socket having two or four slots, with the slots offset from one another 90° and/or 180° from one another. The second end can also include indicia elements and/or a torque indicating mechanism like the first end. The respective ends can thus service, install and appropriately torque a three-blade broadhead, or a two- or four-blade broadhead.

In yet another embodiment, the tool can be configured to apply and/or indicate a preselected torque to a fastener, such as a bolt, nut, screw, threaded device, or other element that is installed via rotation. The tool can be outfitted with a drive feature or a socket to receive the drive feature. The drive feature can be a hex key, a hexalobular internal drive feature, a hexagonal head, a screwdriver compatible feature, or other structure adapted to engage and rotate the fastener. The tool can include one or more of the features noted in the embodiments above.

In yet another embodiment, the tool adapted for fasteners is operable in first and second modes. In the first mode, the tool is initially installed so that the drive feature engages the fastener without applying substantial torque or a rotational moment to the fastener. In this mode, indicia elements are misaligned with one another. Optionally, the indicia elements can be fixed in relation to the first portion and the second portion respectively, but not relative to one another, that is, they are movable relative to one another. In the second mode, the user exerts a moment on the fastener with the tool. When a predetermined amount of torque is applied to the fastener to appropriately tighten it relative to a work piece, the indicia elements align with one another to indicate to the user that an appropriate amount of torque has been applied to the fastener to install it relative to the work piece. Thereafter, the user can discontinue force application and remove the tool from the fastener.

With the broadhead or fastener tightening tool provided herein, an archer or user can consistently and accurately apply a desired torque to a broadhead to properly install it on an arrow, or bolt, or other projectile, or to a fastener to properly tighten it. This can translate to increased accuracy and consistent shooting, thereby providing the archer with enhanced shooting capabilities, or to properly tightened fasteners.

These and other objects, advantages, and features of the invention will be more fully understood and appreciated by reference to the description of the current embodiments and the drawings.

Before the embodiments are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
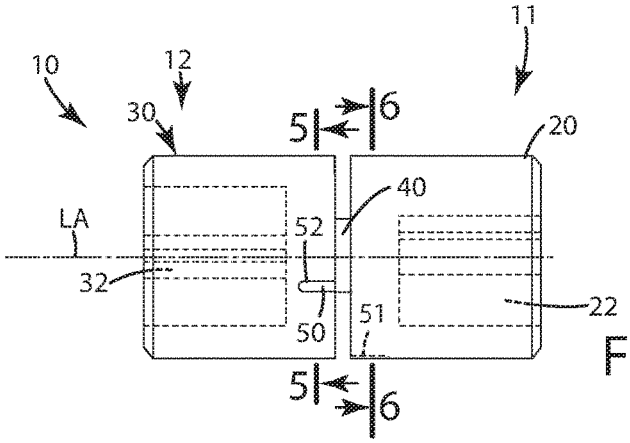
FIG. 1 is a first side view of the broadhead tool of the current embodiment.

A current embodiment of the tool is illustrated in FIGS. 1-9 and generally designated 10. The tool can include a first portion 20 and a second portion 30. The first portion 20 can be located at a first end 11 of the tool while the second portion 30 can be located at a second end 12 of the tool, where the second end optionally can be opposite the first end. The first portion 20 can be joined to the second portion 30 via a connector body 40. The connector body 40 can be constructed to provide or enable relative movement between the first portion 20 and the second portion 30 when a predetermined moment or torque is applied to one of the portions while the other portion is maintained in a stationary or semi-stationary relationship relative to a broadhead. The tool also can include indicia elements 50, and in particular first and second indicia elements 51 and 52. As illustrated, the first and second indicia elements are markings, such as recesses, bumpouts or projections associated with the first portion 20 and the second portion 30.

Figure 8:
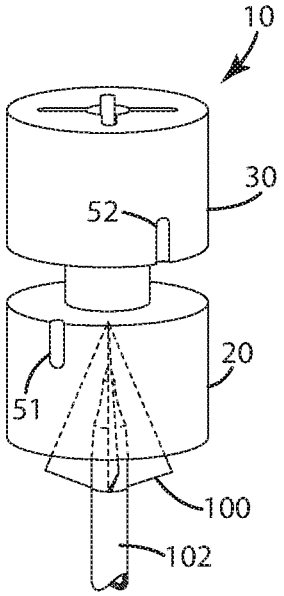
FIG. 8 is a perspective view of the tool installed on a broadhead.
Figure 9:
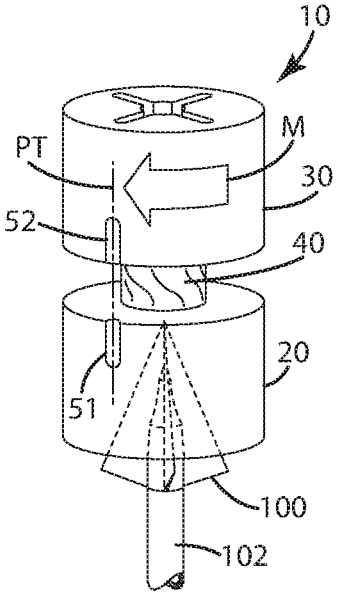
FIG. 9 is a perspective view of the tool being used to tighten the broadhead relative to an arrow and/or an insert.

Generally, as shown in FIG. 8, the tool is applied or installed relative to a broadhead 100 which is further threaded into an insert of an arrow 102. When initially installed, the first end 20 and second end 30 are configured so that the first and second indicia 51 and 52 are misaligned with one another. The archer applies a torque or moment M as shown in FIG. 9 until the broadhead 100 is sufficiently tightened relative to the arrow 102. When the predetermined torque or force or moment M is achieved, the first indicia 51 aligns with the second indicia 52, optionally along a line or plane PT, indicating to a user that a predetermined and desired torque is achieved. This establishes that the broadhead 100 is sufficiently threaded into and attached to the arrow 102. After such attachment and proper tightening, the tool 10 can be removed from the broadhead 100.

Figure 2:
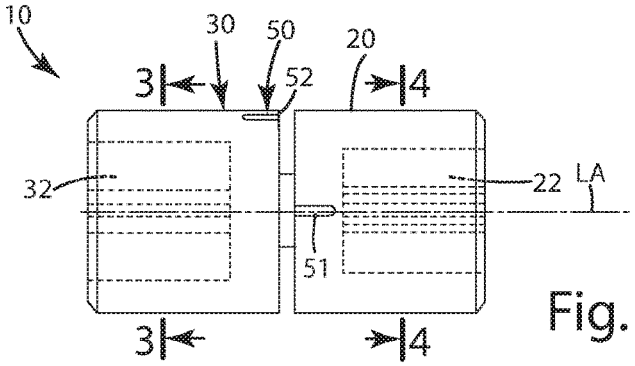
FIG. 2 is a second side view of the broadhead tool.
Figure 3:
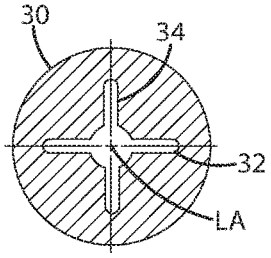
FIG. 3 is a cross-section of the tool taken along lines 3-3 in FIG. 2.
Figure 4:
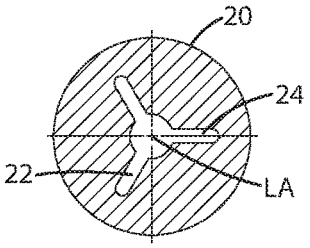
FIG. 4 is a cross-section of the tool taken along lines 4-4 of FIG. 2.
Figure 5:
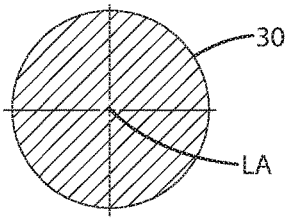
FIG. 5 is a cross-section of the tool taken along lines 5-5 of FIG. 1.
Figure 6:
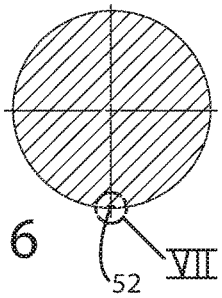
FIG. 6 is a cross-section of the tool taken along lines 6-6 of FIG. 1.
Figure 7:
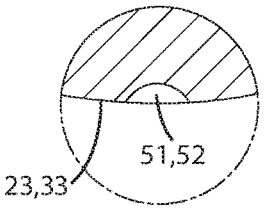
FIG. 7 is a close up view of an indicia element of the tool.

Turning now to FIGS. 1-7, the construction of the tool 10 will now be described in further detail. As shown in FIGS. 1 and 2, the first end 20 defines a broadhead socket 22. As shown in FIG. 4, the broadhead socket 22 can be configured to receive a three bladed broadhead therein. The slots 24 of the socket can accommodate the blades of the three bladed broadhead and a central portion can receive a ferrule of the broadhead. The slots 24 can be offset at about 120° relative to one another. Of course, the slots can be offset at other angles as desired.

The second portion 30 also can include a socket 32 which can accommodate a two or four bladed broadhead. This socket likewise can include slots 34 that receive blades of the respective broadhead in a central portion that receives a ferrule of the broadhead. The slots 34 can be offset at 90° or 180° relative to one another.

Generally, the first portion and second portion are constructed of a cylindrical shape, however, any other geometric shape capable of being gripped by the user is satisfactory. For example, the shape can be a square, elliptical, trapezoidal, triangular or some other geometric shape. Further, although shown as including two substantially similar cylindrical shapes on opposing sides of the connector body one of the portions, for example the second portion 30, could be constructed to include an elongated handle, lever or other structure 136 (FIG. 10) to facilitate manual grasping, extending outwardly from the longitudinal axis LA of the tool a distance greater than the distance by which the first portion 20 extends outwardly from the longitudinal axis. This structure can provide the user with additional leverage.

The first portion 20 and the second portion 30 can be attached via a connector body 40. As illustrated in FIGS. 1 and 2, this connector body 40 optionally can be of a smaller dimension, for example, diameter or cross section, than the respective first portion and second portion. The connector body 40 can be joined with the first portion 20 and the second portion 30 in such a manner that the connector body twists and/or partially deforms so that the first portion 20 and second portion 30 move relative to one another when one of them is held in a fixed position and a sufficient torque or moment is exerted on the other portion. The particular geometric shape of the connector body 40 can be varied from the cylindrical shape as shown in FIGS. 1, 2 and 8. For example, that cylindrical shape of the connector body 40 can be replaced with a square, elliptical, trapezoidal, triangular or other geometric shape.

Optionally, the precise geometric shape can assist in applying a predetermined torque. Further optionally, the connector body can be the same dimension and shape as the first and second portions. For example, the entire tool from the first end to the second end can be of a uniform cross section along the longitudinal axis LA. As a more particular example, the connector body can include an outer surface 140' (FIG. 10) that is cylindrical and contiguous with the exterior surface of the first portion and the second portion. Even further optionally, where the tool is of a uniform cross section, the connector body can be constructed from a softer, more easily deformable material than the first and/or second portions, so that it readily twists when a preselected moment or torque is applied to the first and/or second portions and the other portion is stationary.

As shown in FIGS. 1 and 2, the first portion 20 and second portion 30 can each include one or more indicia elements 50. As shown, the first indicia element 51 is associated with the first portion 20 and the second indicia element 52 is associated with the second portion 30. Optionally, the indicia elements 51 and 52 generally are in the form of rounded out recesses (FIG. 7), defined by the exterior 23, 33 of the respective portions. Of course, these indicia elements can be in the form of projections or combinations of projections and recesses. Alternatively, the indicia elements can be in the form of lines or dots or other elements that are printed, painted, coated onto, included in or embedded within the respective first portion 20 and second portion 30.

In operation, the tool 10 is configurable in first and second modes. In these modes, the indicia 51 and 52 can be either misaligned or aligned. For example, as illustrated in FIG. 8, when the tool 10 is at rest, and not being used to install a broadhead, the first indicia 51 and second indicia 52 are generally misaligned with one another. However, when a moment or torque M is applied by a user to the second portion 30 and the first portion 20 is held in a relatively fixed position or stationary configuration as shown in FIG. 9, the second indicia 52 moves relative to the first indicia 51 until ultimately the two indicia align with one another along a predetermined torque reference line or plane PT. At this point, the tool indicates to the user that the broadhead is sufficiently tightened on the arrow 102, and that further toque or moment need not be applied. Thereafter, the user can remove the tool from the broadhead.

Optionally, the indicia elements 50 can include more than the two indicia elements 51 and 52. For example, there may be one, two, three or more additional indicia elements adjacent the second indicia element 52. These additional indicia elements can be associated with other, greater or lesser predetermined torques or moments applied to the tool. With this construction, the user can apply different torques or moments through the tool, with the indicia elements providing visual feedback of the same.

The tool provided herein can be constructed from an elastomeric material, such as urethane, silicone, deformable composites, deformable elastomers, such as rubber or other material, and combinations thereof. The material can exhibit a Shore hardness of approximately 80 A, and optionally in a range of Shore 50 A to Shore 100 A. Optionally, different parts of the tool can be constructed from different materials to provide suitable deformation thereby allowing certain indicia elements to output the amount of torque or moment applied via the tool.

Figure 10:
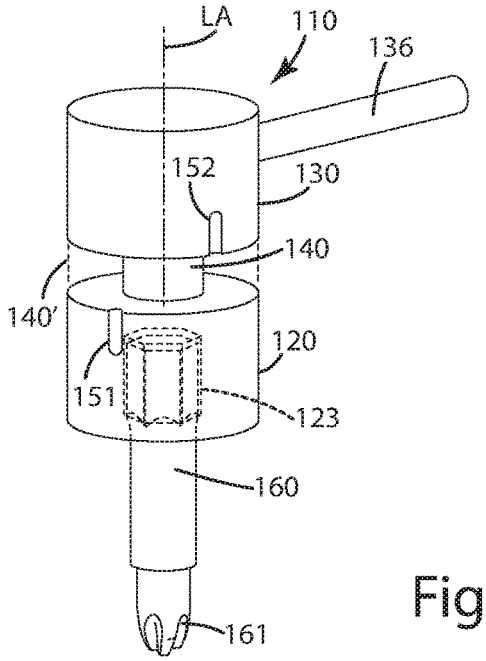
FIG. 10 is a perspective view of a first alternative embodiment of the tool including a drive feature for a fastener.
Figure 11:
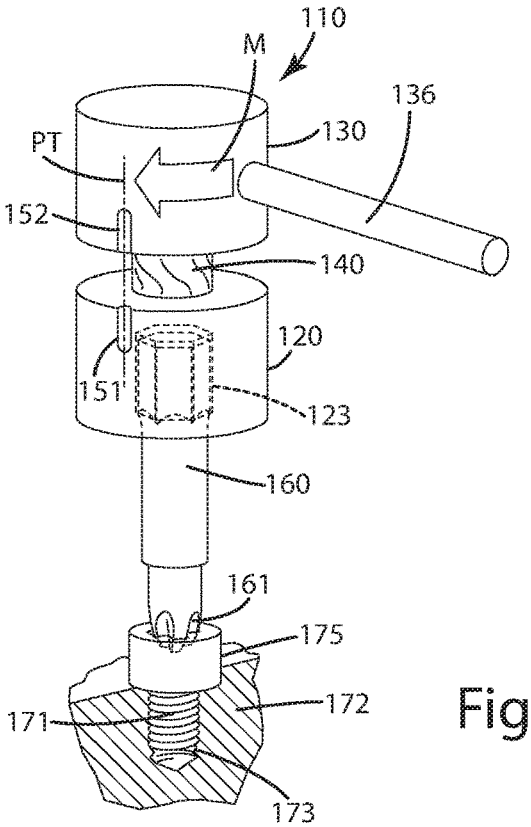
FIG. 11 is a perspective view of the first alternative embodiment of the tool being used to tighten the fastener relative to a work piece.

A first alternative embodiment of the tool is illustrated in FIGS. 10 and 11. This tool 110 is similar in construction and function to the embodiments above with several exceptions. For example, the tool 110 in this embodiment can be used to apply a desired torque or moment to a fastener, and tighten the fastener relative to a work piece. Generally, the tool 110 can be used to apply relatively lower torques or moments to a fastener, for example, optionally about 1 inch pounds to about 20 inch pounds, further optionally 10 inch pounds to 15 inch pounds, and even further optionally about 3 inch pounds to about 6 inch pounds. The fastener can be any bolt, nut, screw, threaded device, or other element that is installed via rotation. As a further example, the fastener can be a screw used to fasten down a scope mount or other firearm or sporting goods accessory relative to another part, generally referred to as a work piece. Of course, the fastener can be constructed in other configurations to fasten to or join other work pieces.

The tool 110 can include a drive feature 160. The drive feature 160 can be a shaft having a tip 161. The drive feature can be installed in a socket 123 defined by the tool. Optionally, the socket can be configured to removably and replaceably receive a variety of different drive features. The drive feature tip 161 can be configured as a hex key, a hexalobular internal drive feature, a hexagonal head, a screwdriver compatible feature, a socket or other structure adapted to engage and rotate the fastener. As shown the drive feature 160 includes a tip with a hexalobular internal drive feature.

In operation, with the drive feature 160 installed relative to the tool 110, a user can engage a fastener 170. The fastener 170 optionally can include a head 175 and a shaft 171 with a corresponding drive feature so that the tip 161 can engage the head satisfactorily, generally allowing the drive feature and the fastener to become stationary relative to one another. The fastener 170 can be configured to thread into a threaded opening 173 defined by a work piece 172.

Optionally, the second portion 130 can include a handle 136 (shown in broken lines) to provide additional leverage to rotate the fastener. While shown in the form of a bar projecting away from a longitudinal axis LA of the tool, the handle can be constructed in any configuration that facilitates manual grasping by a user.

In operation, like the embodiment above, the tool 110 is configurable in first and second modes. In these modes, the indicia 151 and 152 can be either misaligned or aligned. For example, in FIG. 10, when the tool 110 is at rest, and not being used to tighten the fastener 170, the first indicia 151 and second indicia 152 are generally misaligned with one another. However, after the drive feature engages the fastener as shown in FIG. 11, when a moment or torque M is applied by a user to the second portion 130 and the first portion 120 is held in a relatively fixed position or stationary configuration, the second indicia 152 moves relative to the first indicia 151 until ultimately the two indicia align with one another along a predetermined torque reference line or plane PT. At this point, the tool indicates to the user that the fastener 170 is sufficiently tightened relative to the work piece 172, and that further torque or moment need not be applied. Thereafter, the user can remove the tool from the fastener.

All patents, patent applications, and literature references cited in this specification are hereby incorporated herein by reference in their entirety. In case of conflict, the present description, including definitions, will control.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A tool adapted to output applied torque, the tool comprising:

a first portion defining a socket adapted to receive a fastener and engage the fastener so that the fastener can be tightened relative to a work piece;

a connector body joined with the first portion extending away from the socket adapted to receive the fastener;

a second portion joined with a connector body distal from the first portion, the second portion being manually graspable by a user;

a first indicia element joined with the first portion;

a second indicia element joined with and the second portion;

wherein at least one of the connector body and the second portion are rotatable about a longitudinal axis;

wherein the tool is operable in a first mode in which the first indicia element is misaligned with the second indicia element before a preselected moment is applied by a user to the second portion;

wherein the tool is operable in a second mode in which the first indicia element aligns with the second element when a preselected moment is applied by a user to the second portion while the first portion is held stationary relative to the fastener.

2. The tool of claim 1, wherein the connector body is deformable so as to allow rotation of the second portion relative to the first portion, wherein the connector body non-destructively deforms as the second portion rotates relative to the first portion.

3. The tool of claim 1 wherein at least one of the first portion, the second portion and the connector body is constructed from an elastomeric material.

4. The tool of claim 1 wherein each of the first portion, the second portion and the connector body is constructed from an elastomeric material.

5. The tool of claim 1 wherein the second portion includes the second indicia which is in the form of at least one of a recess and a projection.

6. The tool of claim 5 wherein the second indicia is in the form of a recess defined on an exterior surface of the second portion.

7. The tool of claim 1 wherein the first portion, second portion and connector body are a monolithic, single piece construction that is constructed entirely from an elastomeric material.

8. The tool of claim 7 wherein the elastomeric material is at least one of rubber, urethane, silicone, deformable composites, deformable elastomers and combinations thereof.

9. The tool of claim 8 wherein the elastomeric material has a Shore hardness in the range of Shore 50 A to Shore 100 A, inclusive.

10. A tool adapted to output applied torque, the tool comprising:

a first portion, which at least one of defines a socket adapted to receive a fastener therein and includes a drive feature adapted to engage the fastener, the first portion configured to engage the fastener so that the fastener can be rotated relative to a work piece;

a connector body joined with the first portion;

a second portion joined with a connector body;

a first indicia element joined with the first portion;

a second indicia element joined with the second portion;

wherein at least one of the connector body and the second portion are rotatable about a longitudinal axis;

wherein the tool is operable in a first mode before a preselected moment is applied by a user to the second portion, in the first mode the connector body at least deforming and twisting so that the first indicia element and second indicia element move relative to one another;

wherein the tool is operable in a second mode in which the first indicia element and the second element acquire a preselected orientation relative to one another when the preselected moment is applied by a user to the second portion while the first portion is held stationary relative to the fastener, thereby visually indicating to a user that the preselected moment has been applied to the fastener.

11. The tool of claim 10 wherein the first portion and the second portion are cylindrical and define an exterior surface.

12. The tool of claim 11 wherein the connector body is cylindrical and includes a surface contiguous with the exterior surface of the first portion and the second portion.

13. The tool of claim 10 wherein the first portion and the second portion move relative to one another in the first mode, with the first indicia and second indicia moving into alignment with one another in the first mode.

14. The tool of claim 10 wherein the connector body is void of any portion of the socket defined by the first portion.

15. The tool of claim 10 wherein the first portion, the second portion and the connector body are constructed from an elastomeric material being at least one of rubber, urethane, silicone, deformable composites, deformable elastomers and combinations thereof.

16. The tool of claim 15 wherein the elastomeric material has a Shore hardness in the range of Shore 50 A to Shore 100 A, inclusive, so that at least one of the connector body, first portion and second portion can deform and twist about the longitudinal axis, whereby the second portion moves relative to the first portion.

17. A tool adapted to output applied torque, the tool comprising:

a first portion including a drive feature adapted to engage a fastener so that the fastener can be tightened relative to a work piece;

a connector body joined with the first portion;

a second portion joined with a connector body;

a first indicia element joined with the first portion;

a second indicia element joined with and the second portion;

wherein at least one of the connector body, the first portion and the second portion are rotatable about a longitudinal axis;

wherein the tool is operable in a first mode before a preselected moment is applied by a user to the second portion, wherein in the first mode, the at least one of the connector body, the first portion and the second portion temporarily twist when the at least one of the connector body, the first portion and the second portion rotate about the longitudinal axis, so that the first indicia element and second indicia element move relative to one another;

wherein the tool is operable in a second mode in which the first indicia element and the second element acquire a preselected orientation relative to one another when the preselected moment is applied by a user to the second portion, while the drive feature is held stationary relative to the fastener, thereby visually indicating to a user that the preselected moment has been applied.

18. The tool of claim 17 wherein the first portion, second portion and connector body are a monolithic, single piece construction that is constructed entirely from an elastomeric material.

19. The tool of claim 17 wherein the elastomeric material is at least one of rubber, urethane, silicone, deformable composites, deformable elastomers and combinations thereof.

20. The tool of claim 17 wherein the elastomeric material has a Shore hardness in the range of Shore 50 A to Shore 100 A, inclusive.

* * * * *